US006073725A

United States Patent [19]

Kumher et al.

[11] Patent Number: 6,073,725

[45] Date of Patent: Jun. 13, 2000

[54] MULTI-POSITION LADDER AND SUPPORT THEREFOR

[76] Inventors: Don A. Kumher, 13370 Fisher Rd., Burton, Ohio 44021; Boyd S. Kumher, 925 E. Archwood Ave., Akron, Ohio 44306

[21] Appl. No.: 09/186,863

[22] Filed: Nov. 5, 1998

[51] Int. Cl.[7] ..... E04G 3/14; E04G 3/00; E04C 5/00

[52] U.S. Cl. ..... 182/39; 182/97; 182/127

[58] Field of Search ..... 182/36, 39, 88, 182/127

[56] References Cited

U.S. PATENT DOCUMENTS

| | | | |
|---|---|---|---|
| 888,383 | 5/1908 | Asch . | |
| 1,887,301 | 11/1932 | Gordon | 182/36 |
| 2,840,290 | 6/1958 | Roberts . | |
| 3,434,566 | 3/1969 | Miller . | |
| 4,482,029 | 11/1984 | Prochaska | 182/127 X |
| 4,660,677 | 4/1987 | Hunter | 182/39 X |
| 4,846,303 | 7/1989 | Cooper et al. | 182/36 |
| 5,366,052 | 11/1994 | Keh-Lin | 182/127 |
| 5,653,307 | 8/1997 | Kerr | 182/39 X |

FOREIGN PATENT DOCUMENTS 53-38016 7/1978 Japan .

*Primary Examiner*—Daniel P. Stodola
*Assistant Examiner*—Hugh B. Thompson
*Attorney, Agent, or Firm*—Amin, Eschweiler & Turocy, LLP

[57] ABSTRACT

A multi-position ladder includes a ladder, a longitudinally extending support member for supporting the ladder, and a connecting member connecting the support member and the ladder. The connecting member includes a sliding bar, a pivot bar, and a rotating arm, the sliding bar being in sliding engagement with the support member for permitting lateral shifting movement of the ladder along the support member to one of multiple generally vertical use positions, the pivot bar extending laterally outwardly from the sliding bar for permitting pivotable movement of the ladder about the pivot bar between a generally vertical use position and one of multiple storage positions, and the rotating arm providing tilting movement of the ladder towards or away from a wall to which the support member is attached.

5 Claims, 4 Drawing Sheets

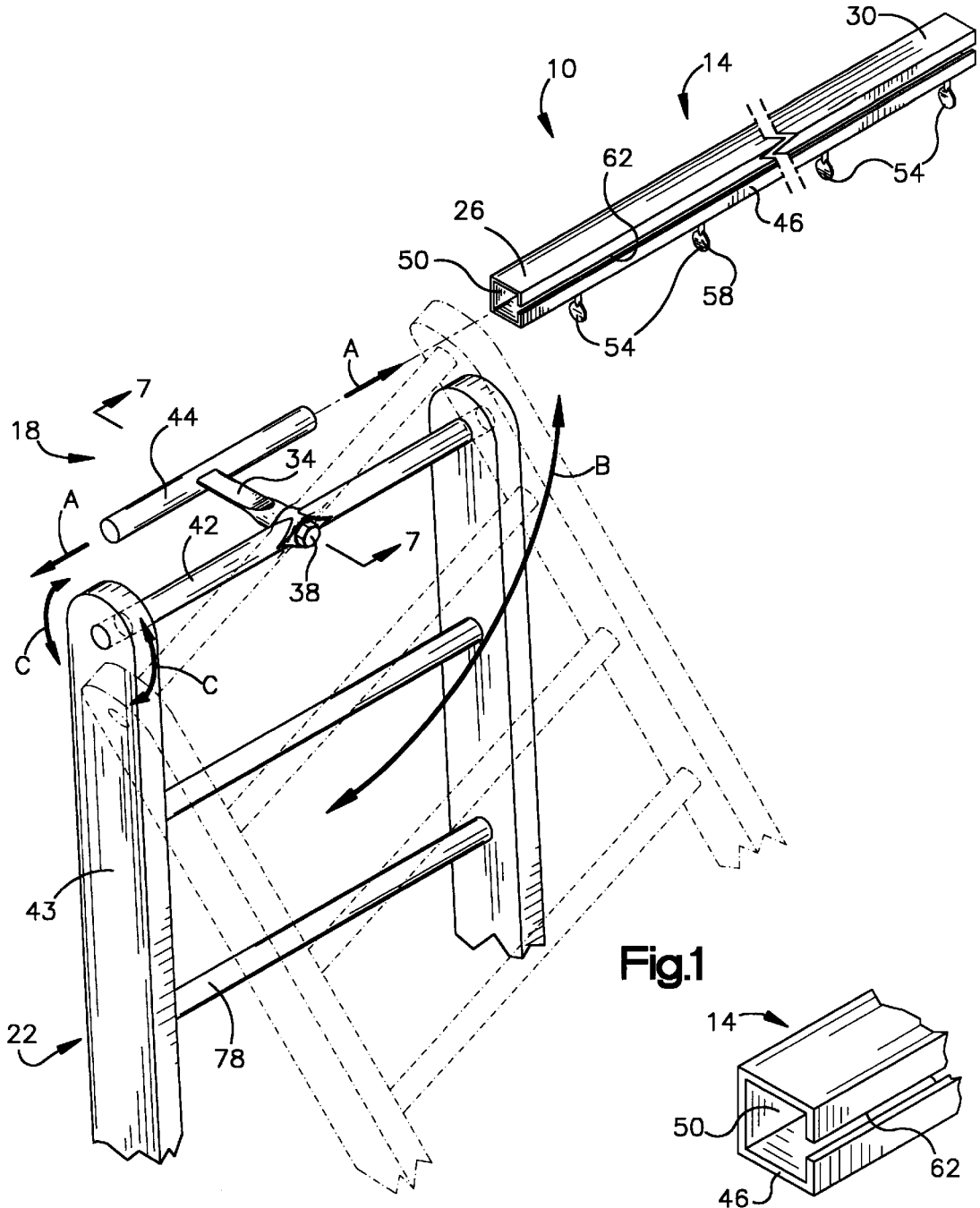
Fig.1
Fig.3
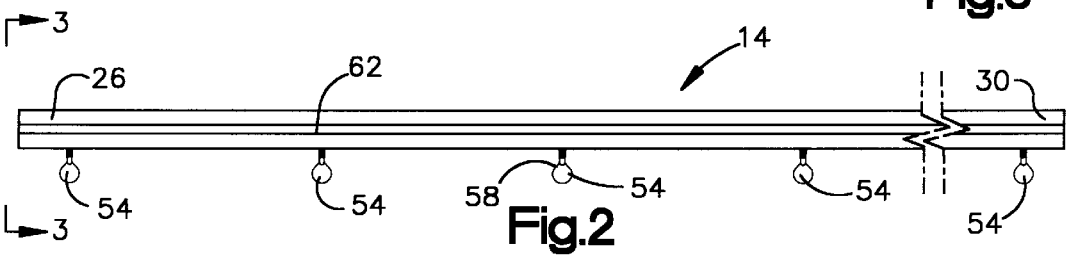
Fig.2

MULTI-POSITION LADDER AND SUPPORT THEREFOR

FIELD OF THE INVENTION

The present invention relates to a multi-position ladder and a support therefor and, more particularly, a ladder that is laterally slidable between multiple generally vertical use positions and pivotable to multiple storage positions along the support.

BACKGROUND OF THE INVENTION

Prior art ladders used in industry and construction are often specifically designed to gain quick access to materials on the roof of a vehicle or on a shelf in a warehouse. In the case of a vehicle, for example, a construction van or truck, the ladder is typically vertically mounted relatively parallel to the side or rear of the vehicle in a single fixedly attached position. In this regard, a worker must maneuver the vehicle prior to loading or unloading materials to orientate the ladder to an accessible position relative to the desired materials site. This oftentimes is inconvenient, for example, in tight work zones or storage places.

In the case of a warehouse, typically the ladder must be removed from a storage site, carried to the desired materials location, raised to the desired height for loading or unloading of materials, lowered and then returned to the storage site. This can be burdensome and inconvenient especially in crowded work zones or if frequent loading and unloading are required.

What is needed is a ladder that may be conveniently moved to an out-of-the-way yet accessible position, conveniently positioned for access to the roof of a vehicle or a shelf of a warehouse, and also readily and conveniently returned to its storage position.

SUMMARY OF THE INVENTION

The present invention provides a multi-position ladder assembly comprising a ladder and a support for supporting the ladder, wherein the assembly permits the ladder to be shifted laterally across the support, pivotably moved in a lateral direction, and tilted toward and away from the support.

According to one aspect of the invention, the multi-position ladder assembly includes a ladder, a longitudinally extending support member for supporting the ladder, and a connecting member connecting the support member and the ladder. The multi-position ladder assembly provides for three types of movement of the ladder. The ladder may be laterally shifted from side to side across the support member, pivotably moved from side to side to a storage position, and/or tilted away from or towards a wall or frame to which the support member is connected. The movements may be made either simultaneously or independently depending on the limitations or needs of a particular loading/unloading site.

According to a preferred embodiment of the invention, the support member comprises a C-shaped guide channel and the connecting member includes a sliding bar that slidably engages the guide channel for permitting lateral positioning of the ladder along the support member to one of multiple generally vertical use positions. The ends of the support member are preferably open permitting the ladder to be laterally removed from either of the ends.

According to a preferred embodiment of the invention, the connecting member includes a pivot arm preferably fixedly attached to and extending laterally outwardly from the sliding bar, and a rotating arm preferably rotatably mounted relatively transverse to the pivot arm. The ladder is rotatably connected to the rotating arm for permitting pivotable movement of the ladder about the pivot arm between a generally vertical use position and one of multiple storage positions.

According to a preferred embodiment of the invention, the guide channel includes an elongated groove therein for slidably receiving the sliding bar. The sliding bar slidably engages the groove during lateral positioning of the ladder. The guide channel also defines an elongated slot substantially aligned with the elongated groove and a guide pin is fixedly attached to and extends laterally outwardly from the sliding bar. The guide pin slidably engages the elongated slot thereby guiding the connecting member and, consequently, the ladder during lateral positioning thereof.

According to a preferred embodiment of the invention, the ladder includes a pair of spaced upright members and a plurality of spaced parallel rungs extending between the upright members. The rotating bar is pivotably mounted at its ends within recesses disposed in the upright members and is substantially parallel to the rungs.

Although the invention is shown and described with respect to one or more preferred embodiments, it is to be understood that equivalents and modifications will occur to others skilled in the art upon the reading and understanding of the specification. The present invention includes all such equivalents and modifications, and is limited only by the scope of the claims.

BRIEF DESCRIPTION OF THE DRAWINGS

FIG. 1 is a perspective view of a multi-position ladder constructed in accordance with the present invention;

FIG. 2 is a front elevation view of the support member of the multiposition ladder of FIG. 1;

FIG. 3 is a perspective view of an end of the support member of the multi-position ladder of FIG. 1 shown from the plane 3—3 in FIG. 2;

DETAILED DESCRIPTION OF PREFERRED EMBODIMENTS

Figure 4:
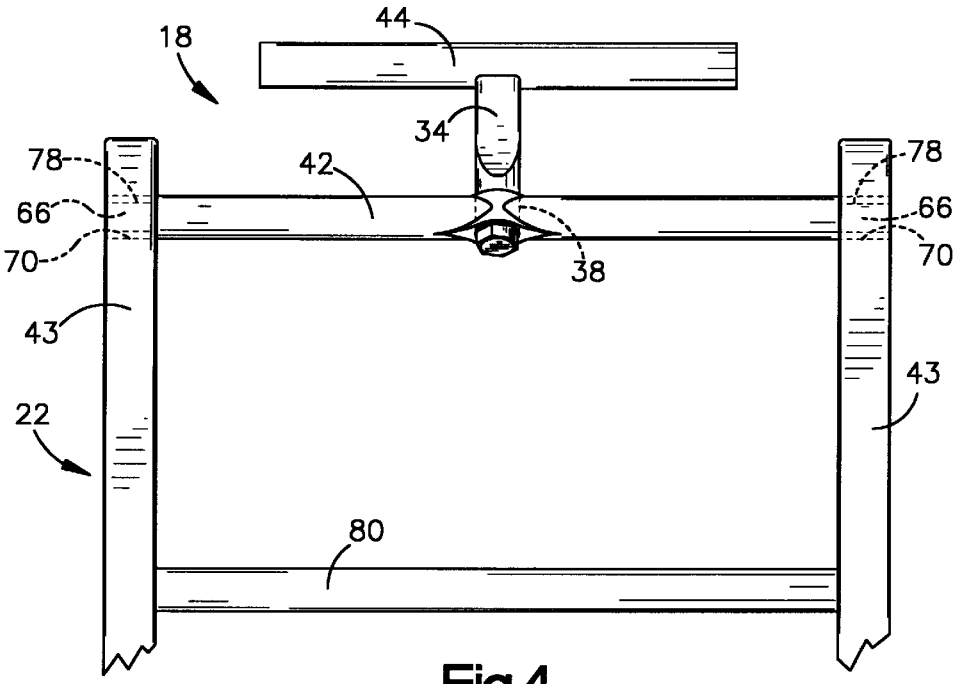
FIG. 4 is a front elevation view of the connecting member of the multi-position ladder of FIG. 1 shown with the sliding bar and pivot arm rotated slightly out of position relative to the rotating bar for clarity purposes.

Referring now to the Figures, there is seen in FIG. 1 a multi-position ladder constructed in accordance with the present invention generally indicated at reference numeral 10. The multi-position ladder 10 includes a longitudinally extending support member 14 preferably fixedly mounted (not shown), for example, to the side or rear of a vehicle or to the frame of a warehouse shelf. A connecting member 18 is mounted to the support member 14 and is adapted to carry laterally therealong a ladder 22 from one end or side 26 of the support member 14 to the other end or side 30 of the support member 14; the arrows A—A in FIG. 1 being representative of the lateral motion of the ladder 22.

The connecting member 18 includes an outwardly extending pivot arm 34. The ladder 22 is pivotably mounted to the pivot arm 34 via a bushing 38 or other suitable pivotable connection for permitting the ladder 22 to be pivoted, or swung, from side to side. This pivoting motion may be, for example, as shown in FIG. 1, in the same plane as the plane of lateral shifting motion; the arc B—B in FIG. 1 being representative of such pivoting motion of the ladder 22. As will be described below, the plane of pivoting motion varies with respect to the tilt position of the ladder 22. A rotating arm 42 is preferably rotatably mounted to the pivot arm 34 and preferably pivotably mounted to ladder uprights 43 of the ladder 22 for permitting the ladder 22 to tilt away from or towards a wall to which the support member 14 is attached. As shown in FIG. 1, the tilting is in a plane perpendicular to the aforedescribed lateral shifting motion and pivoting motion of the ladder 22; the arc C—C in FIG. 1 being representative of such tilting motion of the ladder 22.

In view of the foregoing, it will be appreciated that the ladder 22 may be moved from side to side along the support member 14 to any of a wide range of generally vertical use positions, thus permitting a worker to move the ladder 22 to a position, for example, having the most direct or convenient access to materials on the roof of a vehicle or on the shelf of a warehouse. After use, the ladder 22 can then be pivoted, or swung, about the pivot arm 34 along the arc B—B and raised to a suitable storage position sufficiently high to clear the ground or warehouse floor, or to an otherwise "out-of-the-way" position. The ladder 22 may also be tilted outwardly away from the wall of the vehicle or shelf of a warehouse so that it is raised up from the ground (or floor) to facilitate easier lateral shifting motion or pivoting motion. These and other advantages, as well as the structure, function and features of the multi-position ladder 10 are described in greater detail below.

The mounting arrangement between the connecting member 18 and support member 14 is described herein with respect to a sliding bar 44 in slidable engagement with a generally C-shaped guide channel 46. The C-shaped guide channel 46 preferably has a lubricant, for example, silicone grease within its groove or a polytetrafluoroethylene coating on its interior walls, for facilitating sliding contact between the surface of the sliding bar 44 and the interior walls. The guide channel 46 includes a groove 50 adapted to slidably receive and provide stable interface contact with the sliding bar 44. The guide channel 46 and sliding bar 44 cooperatively engage to support the weight of the ladder 22 and/or a worker and load thereon. Of course, a round shaped guide channel may be used as an alternative, in which case the sliding bar 44 may include a bushing or other lubricating sleeve for promoting slidability between the round shaped guide channel and the sliding bar 44.

It will be appreciated that the aforedescribed components may be reversed to accomplish substantially the same result; that is, the support member 14 may include a sliding bar 44 and the connecting member 18 may include a C-shaped guide channel 46 that rides laterally along the sliding bar 44. In another alternative embodiment, the support member 14 may include a track or rail and the connecting member 18 may include guide pins or rollers that slidably engage the track or rail during lateral movement of the ladder 22. In this regard, it will be appreciated that alternative parts and/or arrangements may be used to accomplish the same effect of guided lateral shifting movement of the connecting member 18 relative to the support member 14 and such alternatives are contemplated as falling within the scope of the present invention.

The C-shaped guide channel 46 includes suitable fasteners 54 (shown in FIGS. 1 and 2, for example) for securing the sliding bar 44 with respect to the groove 50 of the guide channel 46 when no lateral shifting movement of the ladder 22 along the guide channel 46 is desired. In the illustrated embodiment, the fasteners 54 comprise set screws 54 although there may be other suitable fasteners for preventing sliding movement of the sliding bar 44 relative to the groove 50. For example, a pin could be inserted through transverse holes in the guide channel 46 for preventing movement of the sliding bar 44 with respect to the guide channel 46.

The set screws 54, or other suitable fasteners, may include eye hooks 58 or handles extending therefrom for facilitating a firm grip for tightening the set screws 54. Preferably, the set screws 54 are tightened until they bear against and engage the sliding bar 44 which, in turn, forces a frictional engagement between the sliding bar 44 and guide channel 46 and, consequently, prevents lateral shifting movement of the ladder 22 relative to the vehicle wall or warehouse shelf. As illustrated in FIGS. 1 and 2, the spacing between two adjacent set screws 54 is preferably less than the length of the sliding bar 44 so that at least one set screw 54 is available for securing the sliding bar 44 during use. Of course, depending on the requirements of a particular application the spacing may be narrower so that, for example, at least two fasteners 54 are available for securing the sliding bar 44.

The guide channel 46 also defines an elongated slot 62 in substantial alignment with the groove 50 of the guide channel 46 as illustrated in FIG. 3. The slot 62 is adapted to slidably receive therein the pivot arm 34 extending laterally outwardly from the sliding bar 44. In this regard, the pivot arm 34 acts as a guide pin. As the sliding bar 44 is moved slidably through the guide channel 46, the pivot arm 34 (acting as a guide pin) guides the sliding bar 44 along a relatively straight path as the pivot arm 34 travels within the slot 62. As the pivot arm 34 slidably engages the edges of the slot 62 the sliding bar 44 aligns itself within the groove 50 thereby facilitating relatively smoother or freer lateral shifting movement of the sliding bar 44 through the groove 50. For even freer movement, a lubricant, for example, silicone grease or a polytetrafluoroethylene coating may be applied to the surface of the pivot arm 34 and the coacting edges of the slot 62.

Figure 5:
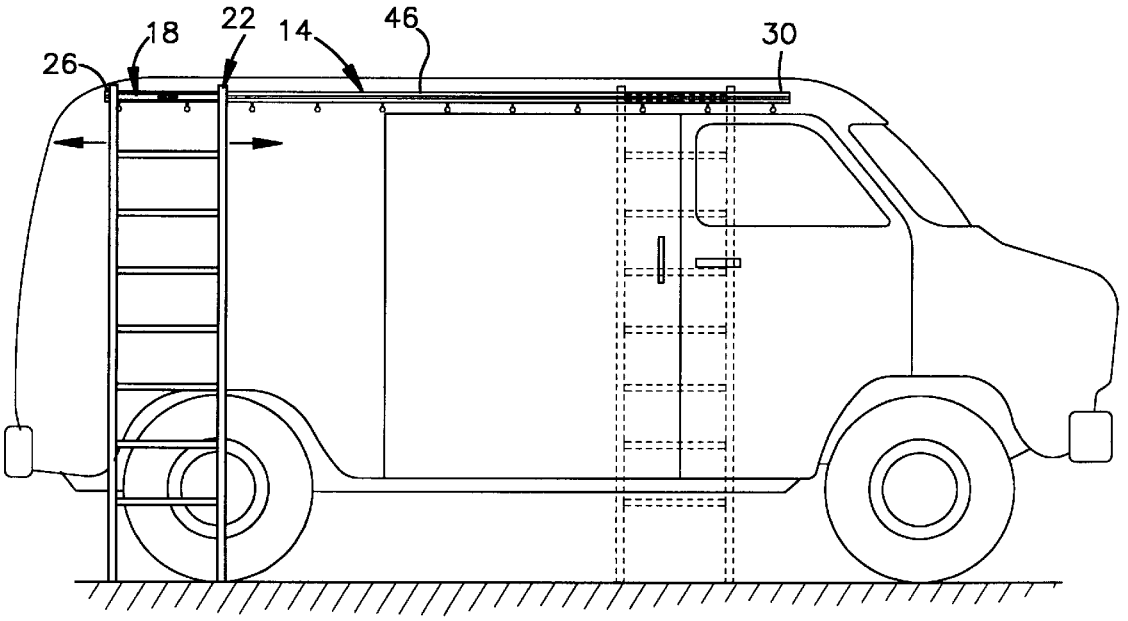
FIG. 5 is a front elevation view of the multi-position ladder of FIG. 1 showing the multi-position ladder on the side of a vehicle in one of multiple generally vertical use positions and, in phantom, in another one of multiple generally vertical use positions.
Figure 7:
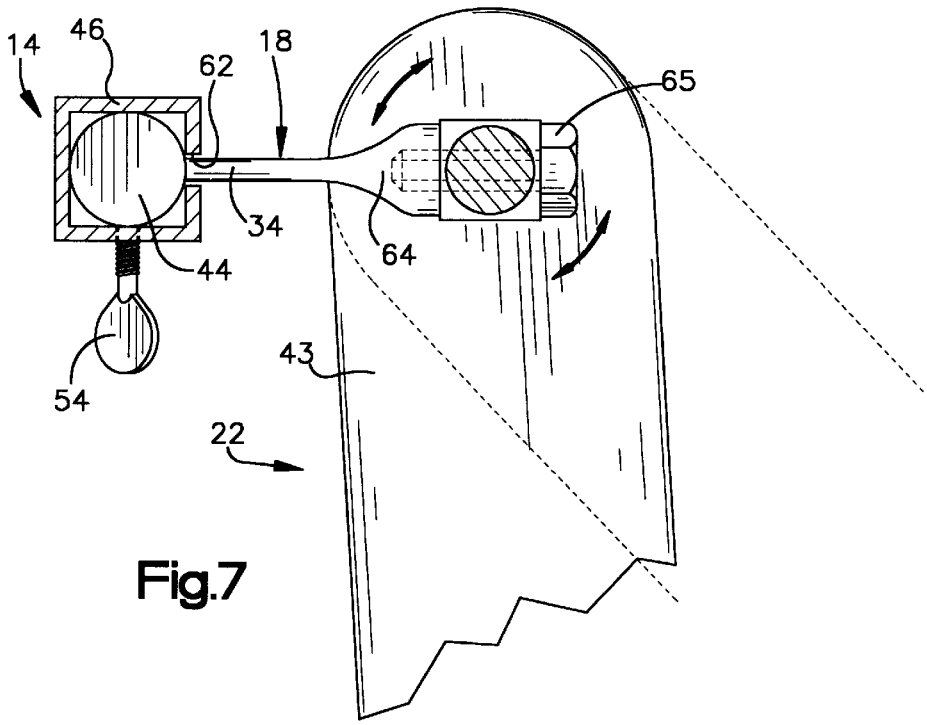
FIG. 7 is a side elevation view of the multi-position ladder of FIG. 1 shown from the plane 7—7 in FIG. 1 and showing the ladder in phantom in a position pivoted away from the wall of the vehicle or the frame of a warehouse shelf.

In operation, lateral shifting movement of the ladder 22 translates into sliding movement of the sliding bar 44 within and along the C-shaped guide channel 46. As shown in FIG. 5 and as can be appreciated in view of the foregoing, the ladder 22 may be laterally shifted to any desirable generally vertical use position along the guide channel 46. In this sense, generally vertical is defined to mean a generally upright position. Therefore, the ladder 22 is in a generally vertical configuration while the ladder 22 is laterally shifted across the guide channel 46 although the ladder 22 may be, and of course usually will be, slightly tilted relative to, for example, the side or rear wall of a vehicle or the frame of a warehouse shelf, as shown in FIG. 7 and described below in greater detail.

Once the desired position is attained, the ladder 22 is secured to the guide channel 46 by tightening the fasteners 54. A worker may then climb the ladder 22 for loading or unloading of materials from, for example, the roof of a vehicle or a warehouse shelf. Should the worker desire closer access to materials further down the roof or shelf the worker can loosen the fasteners 54 and simply laterally shift the ladder 22 to a more convenient position. Alternatively, the ladder 22 may be laterally shifted to one of the ends 26, 30 of the guide channel 46 and removed therefrom or pivoted to a storage position, as described below in greater detail. The fasteners 54 may then be tightened to secure the ladder 22 in its storage position.

As was alluded to above, the pivot arm 34 also permits the ladder 22 to pivot, that is, swing from side to side as is generally represented by the arc-shaped line B—B shown in FIG. 1. As shown in greater detail in FIG. 4, the connecting member 18 further includes the rotating arm 42 which is rotatably mounted at its center onto the pivot arm 34. A bushing 38 or other suitable coupling or bearing member, for example, a roller bearing, is interposed between the pivot arm 34 and rotating arm 42 to ensure relatively stabile rotatable movement of the rotating arm 42 about the pivot arm 34. In the preferred embodiment, the pivot arm 34 includes a boss 64 (FIG. 7) and a polytetrafluoroethylene washer (not shown) against which the rotating arm 42 bears. A polytetrafluoroethylene washer (not shown) and a threaded lug nut 65 retain the rotating arm 42 at the end of the pivot arm 34.

Of course, other suitable pivoting arrangements may be employed to obtain substantially the same result. Thus, for example, in an alternative embodiment, the rotating arm 42 may be fixedly attached to the pivot arm 34 and the pivot arm 34, in turn, pivotably connected to the sliding bar 44. In this regard, the slot 62 may be sized to accommodate such pivotable movement by, for example, providing enlarged, preferably circular, openings spaced along the slot 62 and adapted to receive the width or diameter of the pivot arm 34 as it is pivoted and thereby travels in an arcuate or circumferential path. In another alternative embodiment, the pivot arm 34 itself may be adapted to provide such pivotable movement. The pivot arm 34 may be fixedly attached to both the sliding bar 44 and the rotating arm 42, in which case the sliding bar 44 and rotating arm 42 would take the form of T-shaped brackets, and may include an axial coupling providing pivotable movement, or essentially swivelled movement, between the sliding bar 44 and rotating arm 42. In this regard, it will be appreciated that alternative parts and/or arrangements may be used to accomplish the same effect of pivoting movement of the rotating arm 42 along the arc B—B (FIG. 1) and such alternatives are contemplated as falling within the scope of the present invention.

Referring to FIG. 4, the ends 66 of the rotating arm 42 are rounded and are pivotably received in correspondingly sized holes 70 in the upper portion of the ladder uprights 43. A bushing 78 or other suitable bearing member may be disposed within the holes 70 to ensure relatively stabile pivotable movement of the rotating arm's ends 66 within the respective holes 70. In the preferred and illustrated embodiment, the rotating arm 42 takes on the same shape as and is substantially parallel to the rungs 80 of the ladder 22 and may even be used as a top rung when the spacing requirements of a particular application permit. Suitable fasteners, for example, such as those described hereinabove, may be used at the pivot and rotate locations to maintain a relatively fixed connection at, and for preventing pivoting or rotating movement of, the rotating arm 42 relative to the pivot arm 34 and the ladder uprights 43.

Figure 6:
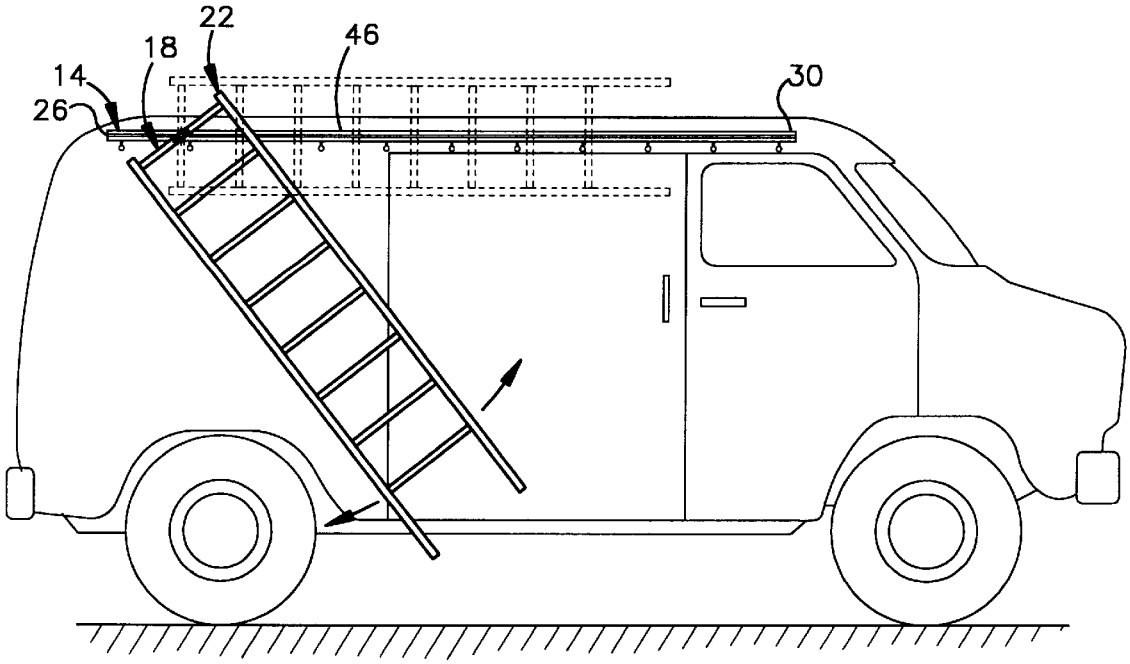
FIG. 6 is a front elevation view of the multi-position ladder of FIG. 1 showing the multi-position ladder on the side of a vehicle in one of multiple storage positions and, in phantom, in another one of multiple storage positions.

In operation, pivoting of the ladder 22 from side to side along the arc B—B (FIG. 1) translates into rotating of the rotating arm 42 about the pivot arm 34. As shown in FIG. 6 and as can be appreciated in view of the foregoing, the ladder 22 may be pivotably moved to any desirable storage position and most preferably a generally non-vertical storage position. In this sense, generally non-vertical is defined to mean any position other than a generally upright position. The ladder 22 may be pivotably moved from side to side although the ladder 22 may be, and of course usually will be, slightly tilted relative to, for example, the side or rear wall of a vehicle or the frame of a warehouse shelf, as shown in FIG. 7 and described below in greater detail. Once a desired storage position is attained, the ladder 22 may be secured to the guide channel 46 at the pivot end of the ladder 22 by tightening one or more of the fasteners 54 and/or to the vehicle side wall or the frame of a warehouse shelf at its free end by other suitable fastening means (not shown).

Referring now to FIG. 7, it is seen that the connecting member 18 also facilitates tilting of the ladder 22 outwardly and/or inwardly with respect to the wall or frame (not shown) to which the guide channel 46 is mounted. The rotating arm 42 permits the ladder uprights 43 to rotate about the rotating arm 42 in a plane (for example, line C—C in FIG. 1) perpendicular to the plane of lateral shifting movement of the ladder 22 (for example, line A—A in FIG. 1). Advantageously, by tilting the ladder 22 in such a manner the lower ends of the ladder uprights 43 are raised above the ground (or floor) thereby providing a clearance, or gap, that facilitates relatively easier lateral shifting movement of the ladder 22 across the guide channel 46 or pivotable movement of the ladder 22 about the pivot arm 34. Also, the inclination angle of the ladder 22 may be adjusted by placing a block or other suitable support beneath the ladder uprights 43 after raising the ladder 22 by tilting.

Figure 8:
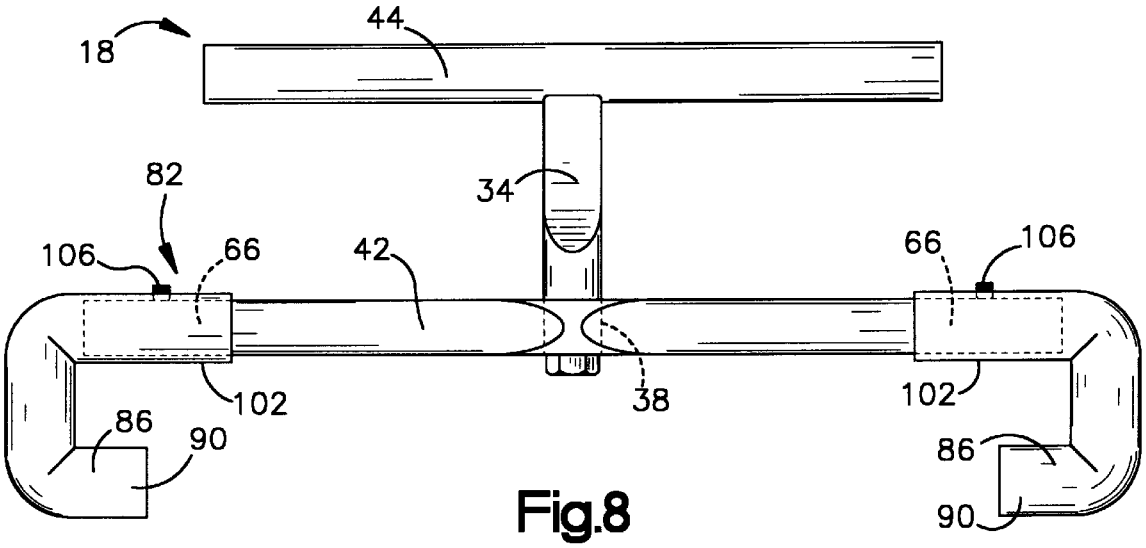
FIG. 8 is an alternative embodiment of a connecting member constructed in accordance with the present invention and, more particularly, a connecting member adapter for connecting an existing ladder to the support member of the present invention.
Figure 9:
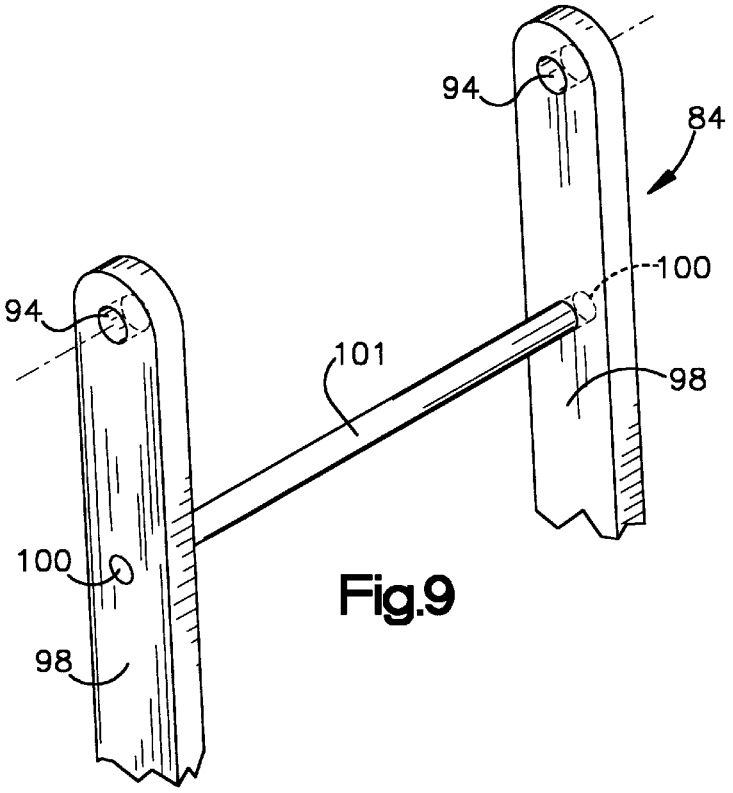
FIG. 9 is a perspective view of an exemplary existing ladder for connection with the connecting member of FIG. 8.

FIG. 8 shows a connecting member adapter 82 that may be used to adapt the connecting member 18 to an existing ladder 84 (FIG. 9). The adapter 82 includes a pair of U-shaped members 86. One leg 90 of each U-shaped member 86 pivotably fits into a correspondingly sized receiving hole 94 in the top of respective ladder uprights 98. Alternatively, the legs 90 may be pivotably mounted into ends 100 of a rung 101. To this end, the rung 101 is fixed relative to the ladder uprights 98 and includes an inside diameter sized to receive the legs 90. The other leg 102 forms a collar, or sleeve, the inside diameter of which corresponds to the outside diameter of an end 66 of the rotating arm 42. The ends 66 of the rotating arms 42 are inserted into the respective collar legs 102 and then secured thereto by fasteners 106, for example, a set screw or the like, for fixedly connecting the U-shaped member 86 to the rotating arm 42. Of course, the U-shaped member 86 may be reversed to accomplish substantially the same result. Thus, the legs 102 may be pivotably connected to the ends 66 of the rotating arm 42 while the other legs 90 are secured into the correspondingly sized receiving holes 94 in the ladder uprights 98.

In view of the foregoing, it will be appreciated that the support member 14 and connecting member 18 of the present invention facilitate three types of movement of the ladder 22, namely lateral shifting movement from side to side across the C-shaped guide channel 46, pivotable movement about the pivot arm 34 from side to side, and tilting movement about the rotating arm 42 away from and towards the wall or frame to which the guide channel 46 is connected. The movements may be made either simultaneously or independently depending on, of course, the limitations or needs of a particular loading/unloading site. Also, in the case of a vehicle, additional support members 14 may be mounted to the rear and/or other side of the vehicle to facilitate substantially 270 degree access to the roof of the vehicle. Similarly, additional support members 14 may be mounted to multiple frame members 14 of a warehouse shelf or shelves. In this regard, the support members 14 may be mounted at different levels of shelves so that, for example, adjacent levels may have their ladders 22 selectively aligned for climbing the ladders 22 in sequence and gaining access to the two adjacent levels. After loading and/or unloading is completed, the ladders 22 can then be selectively pivoted to an out-of-the-way storage position. In either case, the multi-position ladder 10 may be conveniently moved to an out-of-the-way yet accessible position, conveniently positioned for access to a loading/unloading site, and readily and conveniently returned to its storage position.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. A multi-position ladder, comprising:

a ladder including a pair of spaced apart ladder uprights;

a longitudinally extending support member for supporting said ladder;

a connecting member connecting said support member and said ladder, said connecting member further comprising:

a sliding bar member cooperatively engaging the longitudinally extending support member, wherein the sliding bar member permits lateral shifting movement and lateral positioning of the ladder to one of multiple generally vertical use positions along the longitudinally extending support member;

a pivot arm coupled to the sliding bar member; and a rotating arm rotatably coupled to the pivot arm and pivotably coupled to the pair of spaced apart ladder uprights, wherein the rotating arm provides rotational movement of the ladder in a first plane which is generally perpendicular to a second plane defined by a lateral shifting movement of the ladder in the generally vertical use position along the support member, wherein the rotational movement alters an inclination angle of the ladder, and wherein the pivot arm provides pivotal movement of the ladder about a pivot point where the ladder couples to the support member via the connecting member, and wherein the pivotal movement occurs about the pivot point in an arc from side to side between a generally vertical use position and a horizontal storage position; and fastening means coupled to the support member for securing the sliding bar of the connecting member to the support member and prohibiting movement of the sliding bar along the support member when the ladder is in use.

2. A multi-position ladder, comprising:

a ladder including a pair of spaced apart ladder uprights;

a longitudinally extending support member for supporting said ladder;

a connecting member connecting said support member and said ladder, said connecting member further comprising:

a sliding bar member cooperatively engaging the longitudinally extending support member, wherein the sliding bar member permits lateral shifting movement and lateral positioning of the ladder to one of multiple generally vertical use positions along the longitudinally extending support member;

a pivot arm coupled to the sliding bar member; and a rotating arm rotatably coupled to the pivot arm and pivotably coupled to the pair of spaced apart ladder uprights, wherein the rotating arm provides rotational movement of the ladder in a first plane which is generally perpendicular to a second plane defined by a lateral shifting movement of the ladder in the generally vertical use position along the support member, wherein the rotational movement alters an inclination angle of the ladder, and wherein the pivot arm provides pivotal movement of the ladder about a pivot point where the ladder couples to the support member via the connecting member, and wherein the pivotal movement occurs about the pivot point in an arc from side to side between a generally vertical use position and a horizontal storage position; and a fastener coupled to the support member, wherein the fastener comprises an engagement member moveable between a non-engaged position in which the sliding bar is moveable along the longitudinally extending support member and an engaged position in which the fastener prohibits movement of the sliding bar along the longitudinally extending support member.

3. The ladder of claim 2, wherein the engagement member comprises a set screw.

4. The ladder of claim 2, wherein the engagement member comprises a pin.

5. The ladder of claim 4, wherein the pin comprises a biased pin, wherein the bias compels the pin into the engaged position.

* * * * *

UNITED STATES PATENT AND TRADEMARK OFFICE

CERTIFICATE OF CORRECTION

PATENT NO. : 6,073,725
DATED : June 13, 2000
INVENTOR(S) : Don A. Kumher, Boyd S. Kumher It is certified that error appears in the above-identified patent and that said Letters Patent is hereby corrected as shown below:

Title page,
Item [75] Inventors: please insert the following,:
Don A Kumher,13770 Fisher Rd.,
Burton, Ohio 44021; Boyd S. Kumher,
18057 Claridon-Troy Rd., Hiram, Ohio 44234

Signed and Sealed this

Nineteenth Day of March, 2002

*Attest:*

*Attesting Officer*

JAMES E. ROGAN
*Director of the United States Patent and Trademark Office*